US007005613B1

(12) United States Patent
Spohn

(10) Patent No.: US 7,005,613 B1
(45) Date of Patent: Feb. 28, 2006

(54) METHOD FOR CLEANING OVENS AND MERCHANDISED ARTICLE RELATING THERETO

(75) Inventor: Peter D. Spohn, Brookline, NY (US)

(73) Assignee: Saint-Gobain Performance Plastics Corporation, Worcester, MA (US)

( * ) Notice: Subject to any disclaimer, the term of this patent is extended or adjusted under 35 U.S.C. 154(b) by 0 days.

(21) Appl. No.: 11/015,733

(22) Filed: Dec. 17, 2004

(51) Int. Cl.
*H05B 6/80* (2006.01)
*F24C 15/16* (2006.01)
*A21B 3/00* (2006.01)

(52) U.S. Cl. ..... 219/391; 219/725; 219/756; 219/762; 219/392; 126/39 M

(58) Field of Classification Search ..... None
See application file for complete search history.

(56) References Cited

U.S. PATENT DOCUMENTS 3,159,156 A * 12/1964 Incledon ..... 126/19 R
3,630,802 A 12/1971 Dettling
3,650,880 A 3/1972 Tieniber
3,782,360 A 1/1974 Brucken
3,788,106 A 1/1974 True
3,990,932 A 11/1976 Dupire
3,991,257 A 11/1976 Mayer et al.
4,123,313 A 10/1978 Queen et al.
4,139,591 A 2/1979 Jurisich
4,233,358 A 11/1980 Jones et al.
4,248,652 A 2/1981 Civardi et al.
4,275,104 A 6/1981 De Nagybaczon
4,307,659 A 12/1981 Martin et al.
4,495,251 A * 1/1985 Eichelberger et al. ..... 428/548
4,543,145 A 9/1985 Schnell et al.
4,633,052 A * 12/1986 Beavers et al. ..... 219/733
4,698,110 A 10/1987 Vassiliou
4,702,956 A 10/1987 Wilson et al.
4,757,940 A 7/1988 Quick et al.
4,770,927 A 9/1988 Effenberger et al.
4,816,330 A 3/1989 Freund et al.
4,883,716 A 11/1989 Effenberger et al.
4,943,473 A 7/1990 Sahatjian et al.
5,075,065 A 12/1991 Effenberger et al.
5,328,510 A 7/1994 Hofmann et al.
5,472,541 A 12/1995 Simmons et al.
5,490,893 A 2/1996 Enlow et al.
5,759,924 A 6/1998 Sahlin
5,893,957 A 4/1999 Suzuki
6,001,207 A 12/1999 Enlow et al.
6,086,699 A 7/2000 Nakashima et al.
6,225,603 B1 * 5/2001 Wai ..... 219/391
6,383,325 B1 5/2002 Tsai
6,759,636 B1 * 7/2004 Stutman ..... 219/679
2001/0034170 A1 10/2001 Keese

FOREIGN PATENT DOCUMENTS

FR 2053530 A * 4/1971

(Continued)

*Primary Examiner*—Joseph Pelham
(74) *Attorney, Agent, or Firm*—Toler, Larson & Able, LLP

(57) ABSTRACT

The disclosure is directed to a method for cleaning an oven. The method includes placing an oven liner in an oven. The oven liner has a first major surface formed of silicone elastomer and has a second major surface formed of fluorinated polymer. The method further includes cooking food items in the oven and over the oven liner and removing the oven liner.

20 Claims, 3 Drawing Sheets

FOREIGN PATENT DOCUMENTS

| | | | |
|---|---|---|---|
| FR | 2636410 A | * | 3/1990 |
| WO | WO 01/03518 A1 | | 1/2001 |
| WO | WO 03/078173 A1 | | 9/2003 |
| WO | WO 04/014108 A1 | | 2/2004 |

* cited by examiner

METHOD FOR CLEANING OVENS AND MERCHANDISED ARTICLE RELATING THERETO

FIELD OF THE DISCLOSURE

This disclosure, in general, relates to methods for cleaning ovens.

BACKGROUND

Cooking or baking food items in ovens often leads to spilling and food splatter. In microwave ovens, cooking of a food item can lead to food splatter caused by release of steam during cooking or overflow of food from its cooking container. Splatter and overflow result in sticky or hardening food particles stuck on major surfaces of the microwave oven. In conventional ovens, spilling or splattering of food particles can lead to charring of the food particles that remain on the oven floor or wall. Spills or splatters that remain in ovens during subsequent cooking tend to produce odors that alter the flavor of subsequently cooked foods and may be unsanitary. Accordingly, periodic removal of food remnants and residue from oven surfaces is generally desirable, but is a difficult and time consuming chore.

In an attempt to facilitate oven cleaning, many chemicals have been introduced into the marketplace. However these chemicals are often harsh and may be hazardous to the health of a user. In addition, oven manufacturers have attempted to make self-cleaning ovens to ease the burden of oven cleaning. However, during the self-cleaning process, the ovens generate a considerable amount of heat and may generate unpleasant odors, and self-cleaning techniques are limited to conventional ovens and are generally unavailable for microwaves. As such, improved methods for operating and cleaning ovens would be desirable.

SUMMARY

In one particular embodiment, the disclosure is directed to a method for cleaning an oven. The method includes placing an oven liner in an oven. The oven liner has a first major surface formed of silicone elastomer and has a second major surface formed of fluorinated polymer. The method further includes cooking food items in the oven and over the oven liner and removing the oven liner.

In another embodiment, the disclosure is directed to a merchandised article including an oven liner having a first major surface formed of silicone elastomer and having a second major surface formed of fluorinated polymer. The merchandised article also includes packaging coupled to the oven liner. The packaging provides a sales message associated with the oven liner. In addition, the merchandised article includes printed instructions included with the packaging. The printed instructions direct a user to place the oven liner in an oven prior to cooking a food item.

In a further embodiment, the disclosure is directed to a method of cleaning an oven. The method includes placing an oven liner in an oven. The oven liner has a first major surface formed of elastomeric material having a high coefficient of friction. The oven liner has a second major surface formed of a polymeric material having a low coefficient of friction. The method also includes cooking a food item in the oven and removing the oven liner from the oven.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION OF THE DRAWINGS

In one particular embodiment, the disclosure is directed to a method for cleaning an oven. The method includes placing an oven liner in an oven, cooking food items in the oven, and removing the oven liner from the oven. The method may further include cleaning the oven liner, and replacing the oven liner back into the oven.

In one exemplary embodiment, the oven liner has a first major surface formed of low surface energy, high coefficient of friction material, such as silicone elastomer. The oven liner also includes a second major surface formed of low surface energy material, such as fluorinated polymer. In one embodiment, the second major surface has a lower coefficient of friction than the first major surface. In one particular embodiment, the oven liner is placed in the oven such that the first major surface contacts the surface of the oven, exposing the second major surface to food splatter and spilled food debris. The oven may be a microwave oven or a conventional oven.

In another exemplary embodiment, the disclosure is directed to a merchandised article including an oven liner and packaging. The oven liner includes a first major surface formed of silicone elastomer, and a second major surface formed of fluorinated polymer. The packing is coupled to (e.g. attached to, or enclosing) the oven liner and may include marketing information, for example, indicating that the oven liner is for sale. Such information may include sales text, pricing information, or a bar code. In addition, the merchandised article includes printed instructions. The printed instructions may be included on the packaging or included as a separate printed sheet. In one exemplary embodiment, the printed instructions direct a user to place the oven liner in an oven prior to cooking food. The instructions may further direct a user to place the first major surface face down in the oven.

Figure 1:
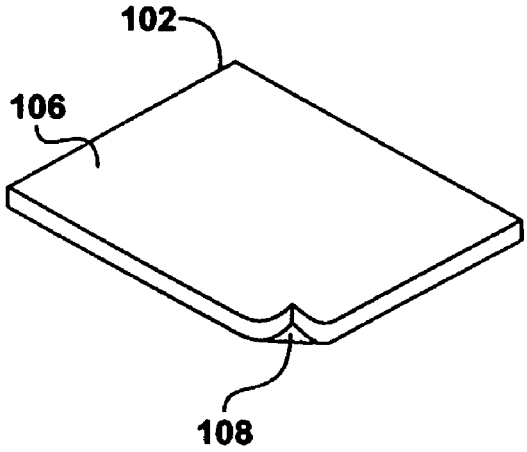
FIG. 1 includes a diagram illustrating an exemplary embodiment of an oven liner.

FIG. 1 illustrates an exemplary oven liner 102 that includes a first major surface 106 and a second major surface 104. The first major surface 106 is formed of low surface energy, high coefficient of friction material, such as silicone elastomer. The second major surface 104 is formed of low surface energy, low coefficient of friction material, such as fluorinated polymer. In one particular embodiment, the low surface energy surfaces provide nonstick and stain-resistant surfaces.

Figure 2:
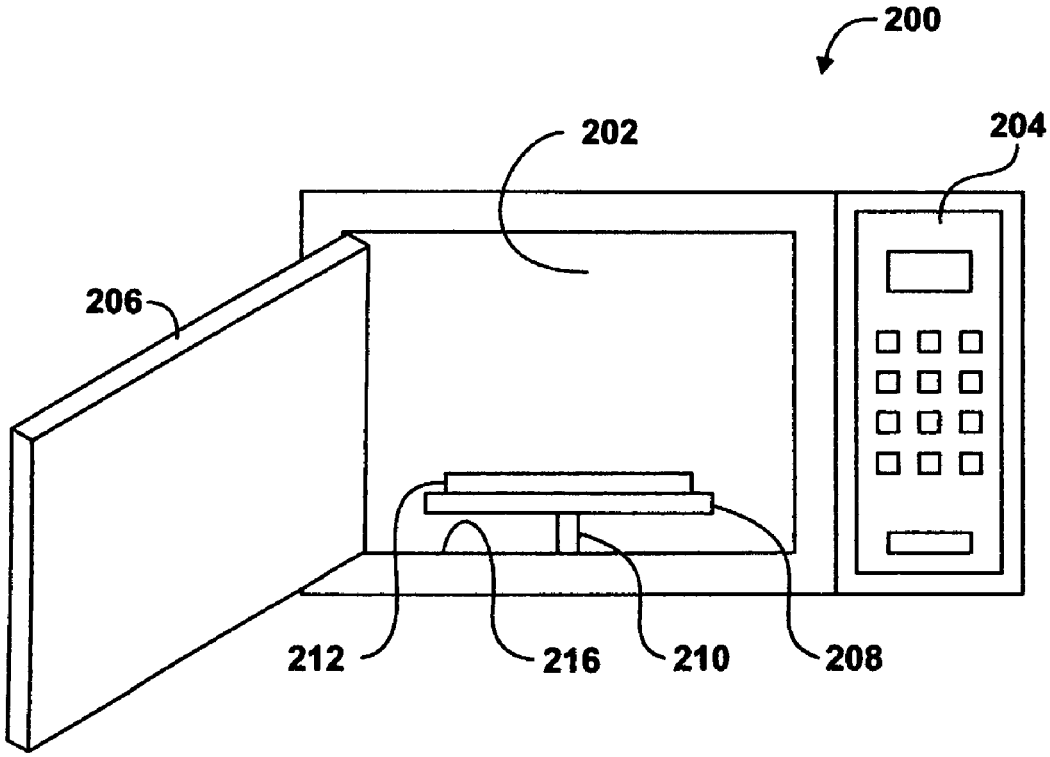
FIGS. 2 and 3 include diagrams illustrating exemplary ovens.
Figure 3:
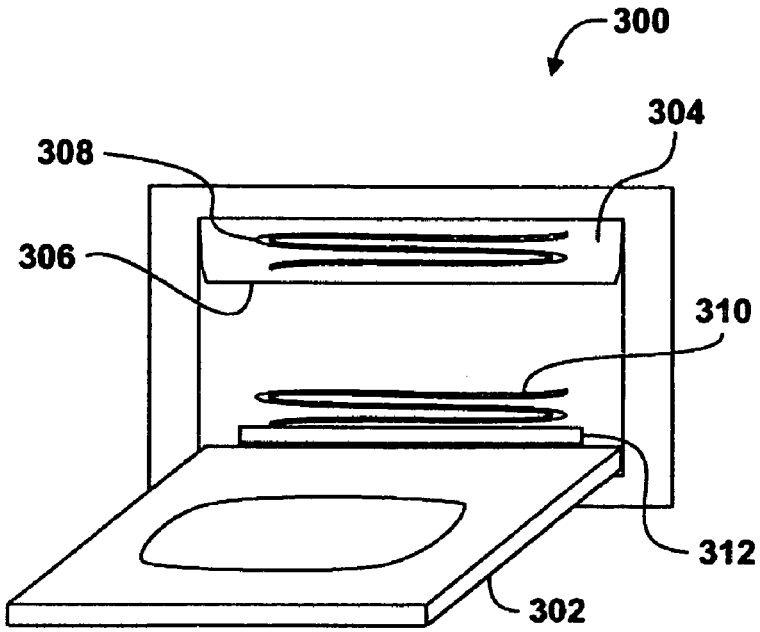

FIGS. 2 and 3 illustrate exemplary ovens in which an oven liner may be placed. FIG. 2 includes a diagram illustrating an exemplary microwave oven 200. The microwave oven 200 includes a cooking chamber 202 and a control panel 204. Generally, food items are placed in the cooking chamber and the user closes door 206, selects a cooking time using control panel 204, and the microwave oven 200 cooks the food items.

The cooking chamber 202 generally includes an oven tray 208. Optionally, the microwave oven 200 may include a mechanism 210 for rotating the oven tray 208 during cooking operations. In one exemplary embodiment, the oven liner 212 is placed on the cooking tray 208. Food items may be placed on the oven liner 212 for cooking. As a result, overflow and splatter land on the oven liner, and generally do not land on the surface of the tray. Generally, the oven liner may be removed and cleaned more easily than the cooking tray 208 or other surfaces of the chamber 202.

Alternatively, or additionally, the oven liner may be configured to be placed on the bottom surface 216 of the oven 200. In this case, the liner has a different geometric configuration than liner 212, and may be configured to cover most of the bottom surface, such as at least 70, 80, or even 90% or greater.

In one particular embodiment, the oven liner 212 includes a first major surface formed of silicone elastomer and a second major surface formed of fluorinated polymer. In one example, the first major surface formed of silicone elastomer is placed face down in the oven tray 208 and food items are placed on the second major surface formed of fluorinated polymer. The oven liner 212 may be shaped to conform to the oven tray 208. For example, the oven liner 212 may be circular, square, or rectangular, depending on the shape of the oven tray 208. Shaping may be performed by the user.

FIG. 3 includes a diagram illustrating an exemplary conventional oven 300. The conventional oven includes a chamber 304. Food items may be placed on a tray 306 within the chamber 304 and the oven door 302 is generally closed, allowing heat to build up in the oven chamber 304, cooking the food. For example, an electric conventional oven may include heating elements 308 and 310. In one example, element 308 may be useful in broiling food and electrical element 310 may be useful in heating food items from the bottom (e.g. baking). Alternatively, the oven 300 may be a gas oven. In another exemplary embodiment, the oven 300 may be a toaster oven.

In one exemplary embodiment, the oven liner 312 is placed in the bottom of chamber 304. A first major surface of the oven liner 312 formed of silicone elastomer is placed face down at the bottom of the oven chamber 304. The second major surface of the oven liner 312, which is formed of fluorinated polymer, such as PTFE, may catch splatter or overflow from food items being cooked on the tray 306. To clean the oven, the oven liner 312 is removed. The oven liner may then be cleaned and returned to the bottom of the oven 300.

Figure 4:
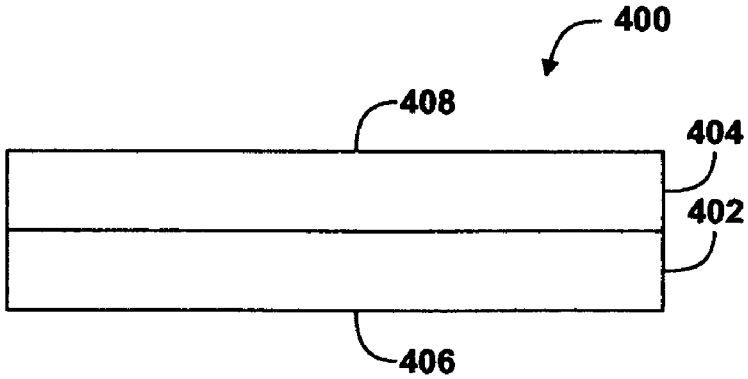
FIGS. 4 and 5 include diagrams illustrating exemplary embodiments of oven liners.
Figure 5:
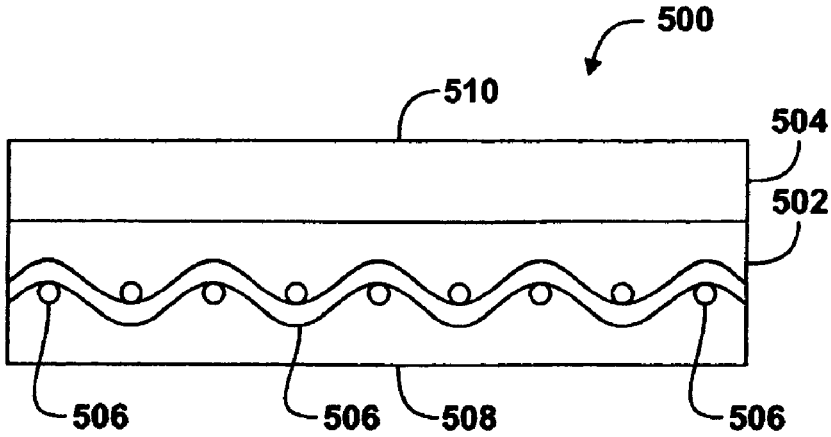

In one exemplary embodiment, the oven liner is formed of at least two layers. FIGS. 4 and 5 illustrate exemplary oven liners. FIG. 4 illustrates a two-layer oven liner 400, in which layers 402 and 404 form opposite major surfaces 406 and 408 respectively.

Layer 402 includes a low surface energy material, such as a non-stick material. In one particular embodiment, the material has a low coefficient of friction. For example, layer 402 may include fluorinated polymer. The fluorinated polymer can be a homopolymer of fluorine-substituted monomers or a copolymer including at least one fluorine-substituted monomer. Exemplary fluorine substituted monomers include tetrafluoroethylene (TFE), vinylidene fluoride (VF2), hexafluoropropylene (HFP), chlorotrifluoroethylene (CTFE), perfluoroethylvinyl ether (PEVE), perfluoromethylvinyl ether (PMVE), and perfluoropropylvinyl ether (PPVE). Examples of fluorinated polymers include polytetrafluoroethylene (PTFE), perfluoroalkylvinyl ether (PFA), fluorinated ethylene-propylene copolymer (FEP), ethylene tetrafluoroethylene copolymer (ETFE), polyvinylidene fluoride (PVDF), polychlorotrifluoroethylene (PCTFE), and TFE copolymers with VF2 and/or HFP. In one particular embodiment, layer 402 includes PTFE.

While layer 402 is illustrated as a single layer, layer 402 may be formed of several layers of one or more fluorpolymers. For example, layer 402 may be formed through coating several layers of fluoropolymer and sintering after each coating or after the final coat is applied.

Layer 404 includes high coefficient of friction material. For example, layer 404 may include elastomeric material. Exemplary materials include polyorganosiloxane, polyolefins, polyurethane, ethylene propylene diene monomer (EPDM) polymers, and mixtures thereof. In one exemplary embodiment, the high coefficient of friction material is substantially free of fluorination. In one particular embodiment, the high coefficient material also has low surface energy and may, for example, be non-stick material. For example, layer 204 may include polyorganosiloxane, such as silicone elastomer.

Other components may be present in the materials used to form layers 402 and 404. For example, the layers can include fillers, light stabilizers, pigments, and bonding aids. Exemplary fillers include talc, silica, and calcium carbonate. Exemplary light absorbing additives and pigments include $TiO_2$, $Fe_2O_3$, carbon black, and calcined mixed metal oxides.

In another exemplary embodiment, the oven liner may include reinforcement, such as fibrous reinforcement. FIG. 5 illustrates an exemplary oven liner 500 including reinforcement 506. Here, layer 502 may include low surface energy material and form a major surface 508. Layer 504 may include high coefficient of friction material and form a major surface 510. Layer 502 may include materials described above in relation to layer 402 of FIG. 4 and layer 504 may include materials described above in relation to layer 404 of FIG. 4. In one exemplary embodiment, the reinforcement material 506 is incorporated into layer 502. Alternatively, the reinforcement material 506 is incorporated into layer 504. In another exemplary embodiment, the reinforcement material 506 is located between layers 502 and 504.

The reinforcement material 506 may be formed of organic or inorganic materials. Exemplary inorganic materials include carbon fiber, metal filament, such as steel and copper wire, ceramic filaments, such as glass fiber, and blends thereof. Exemplary organic materials include natural fibers, such as cotton, wool, and blends thereof and polymeric materials, such as polyester, polyamide, polyaramid, polyamideimide, polyimide, polyolefin, and blends or copolymers thereof. In one exemplary embodiment, the reinforcement material 506 is incorporated into layer 502 and is formed from polyaramid materials, such as meta- or para-polyaramid materials. In another exemplary embodiment, the reinforcement material 506 is incorporated into layer 504 and is formed from polyester materials or polyamide material, such as nylon materials. Generally, the reinforcement material 506 is coated with one or both of the materials of layers 502 and 504, typically coated so as to be generally embedded in one of the layers 502 or 504. More particularly, the reinforcement material 506 may be coated with fluorinated polymer (e.g. embedded in layer 502) or may be coated with silicone elastomer (e.g. embedded in layer 504).

The reinforcement material 506 is generally fibrous, and includes woven fibers (e.g. stitched or in a weave) or non-woven fibers (e.g. randomly distributed fibers). The oven liner may include one or more layers, sheets or types of reinforcement material.

In one particular embodiment, the oven liner is configured to withstand cooking and processing temperatures without charring, burning, or melting. For example, reinforcement materials, low coefficient of friction materials, and high coefficient of friction materials may be selected that withstand cooking temperatures at least about 350° F., such as at least about 450° F., at least about 500° F., or at least about 550° F. In particular examples, reinforcement materials are selected to withstand processing (i.e. fabrication) temperatures of the other materials of the liner. For example, the reinforcement material may be selected to withstand processing temperatures at least about 500° F., such as at least about 600° F., at least about 650° F., or at least about 750° F. In one particular embodiment, a reinforcement material, such as polyaramid, is selected to withstand the processing temperatures of low surface energy, low coefficient of friction material, such as PTFE. One side of the reinforced PTFE may then be coated with high coefficient of friction material, such as silicone elastomer, in a process using lower processing temperatures.

In one exemplary embodiment, the oven liner is formed through a process of coating a carrier web and/or a reinforcement material with a low surface energy, low coefficient of friction material, such as fluorinated polymer. PTFE is one such fluorinated polymer. The carrier web and/or the reinforcement material are paid from a roll and coated on one side with a suspension including fluorinated polymer particles dispersed in a liquid medium. In one particular embodiment, the suspension includes Fluon® ADILN PTFE aqueous dispersion to which 0.5% Zonyl® FSO fluorosurfactant from DuPont has been added.

A blade or metering rods are positioned to remove excess suspension from the carrier web. The suspension is then dried and sintered to form a layer on the carrier web. In one particular embodiment, the coated suspension is dried at about 332° F. and sintered at about 649° F. The thickness of the layer may be increased by repeating the coating process. In one exemplary embodiment, the carrier web may be coated with the suspension, the suspension dried, and a second coating applied to the dried suspension before sintering.

An exposed surface of the fluorinated polymer is rendered bondable. For example, the surface may be chemically etched with an etching composition, such as sodium metal/naphthalene/glycol ether mixture and sodium metal/anhydrous ammonia mixture. In other exemplary embodiments, the surface is rendered bondable through electrochemical treatments, metal sputtering and deposition of metals and/or metal oxides. For example, deposition of metals and metal oxides may include chemical vapor deposition and physical vapor deposition.

In another exemplary embodiment, the surface of the fluorinated polymer is rendered bondable by impregnating the material with colloidal silica. For example, the fluorinated polymer may include 25–70 wt % colloidal silica. In a further example, the surface may be rendered bondable by applying to the surface a coating of FEP or PFA including colloidal silica. The FEP or PFA coating is dried and sintered or fused to the surface of the fluorinated polymer, such as PTFE. In one particular embodiment, the fluorinated polymer surface is coated with a mixture of DuPont FEP TE-9503, Ludox® LS 30 colloidal silica dispersion from W.R. Grace Company, and Triton® X-100 non-ionic surfactant.

Once the surface is bondable, a high coefficient of friction material, such as silicone elastomer, is applied to the bondable surface. For example, precursors of silicone elastomer may be coated on the bondable surface and cured. In one exemplary embodiment, a platinum catalyzed liquid silicone rubber solution is applied to the bondable surface of the fluorinated polymer layer. The coating may be heated to deactivate or evaporate inhibitors, allowing the liquid silicone rubber solution to cure. In another exemplary embodiment, an organic peroxide catalyzed silicone rubber is coated to the fluorinated polymer layer and the coating is heated to facilitate curing. Other exemplary silicone elastomers include moisture-curing silicones. In one particular embodiment, the silicone elastomer precursor coating includes 50 parts 9252-500P Part A and 50 parts 9252-500P Part B liquid silicone rubber from Dow Corning Corporation in which Part A includes a platinum catalyst and Part B includes a crosslinking agent and a cure inhibitor capable of being removed by heat. Multiple coatings of the silicone material may be applied, and reinforcement material may be incorporated in the silicone layer.

In exemplary embodiments, the thickness of the fluorinated polymer layer is generally about 0.2–12 mils. In one example, the thickness is about 4–12 mils. In another example the thickness is about 0.2–4 mils, such as about 0.5–4 mils. The silicone layer is generally about 2–100 mils. In one example, the thickness of the silicone layer is about 4–20 mils. Alternatively, the thickness of the silicone layer is about 2–10 mils, such as about 5–10 mils. For example, when a reinforcement material is embedded in the fluorinated polymer layer, the thickness of the fluorinated polymer layer may be about 4–12 mils and the thickness of the silicone layer may be about 2–10 mils. Alternatively, when the reinforcement material is embedded in the silicone layer, the thickness of the fluorinated polymer layer may be about 0.5–4 mils and the thickness of the silicone layer may be about 4–20 mils.

Figure 6:
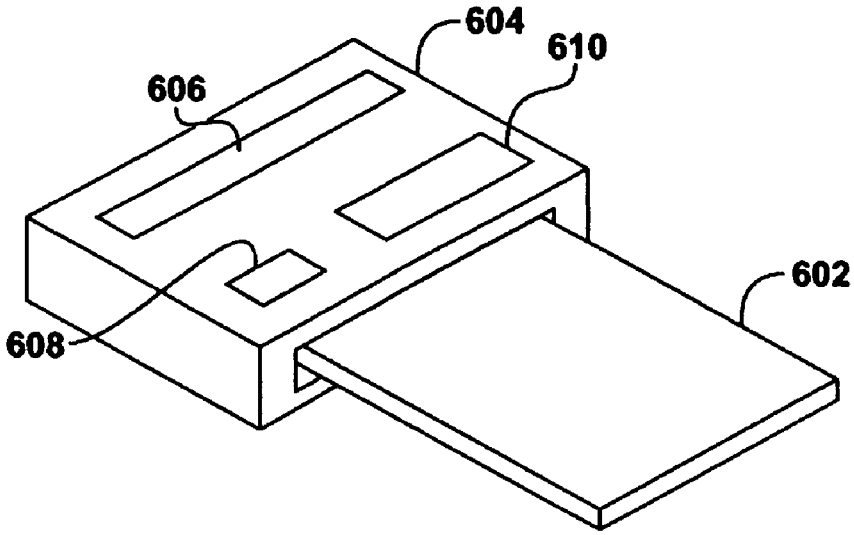
FIG. 6 includes a diagram illustrating an exemplary merchandised article associated with an oven liner.

In one exemplary embodiment, the oven liner is included in a merchandised article for commercial sale. FIG. 6 illustrates a merchandised article including an oven liner 602 and packaging 604. The packaging 604 is connected to the oven liner 602. The packaging 604 may include a sales message, title or description of the oven liner 606 and a barcode 608 or other indicator of sales price or facilitator of a sales transaction.

In addition, the merchandised article may include a set of printed instructions 610. The printed instructions 610 may be printed on the packaging 604 or included as a separate sheet with the packaging 604 and oven liner 602. In one exemplary embodiment, the instructions direct a user to place the oven liner 602 in the oven. In another exemplary embodiment, the instructions 610 direct a user to place a high coefficient of friction side of the oven liner face down in the oven, exposing a low coefficient of friction side of the oven liner. In another exemplary embodiment, the instructions 610 suggest removing the oven liner from the oven and cleaning the oven liner. The instructions 610 may also suggest trimming the liner to fit the particular oven in which it is to be deployed. In this regard, a sheet of material (e.g. paper) may be included for making a pattern of the oven to aid in creating an accurately contoured liner.

Figure 7:
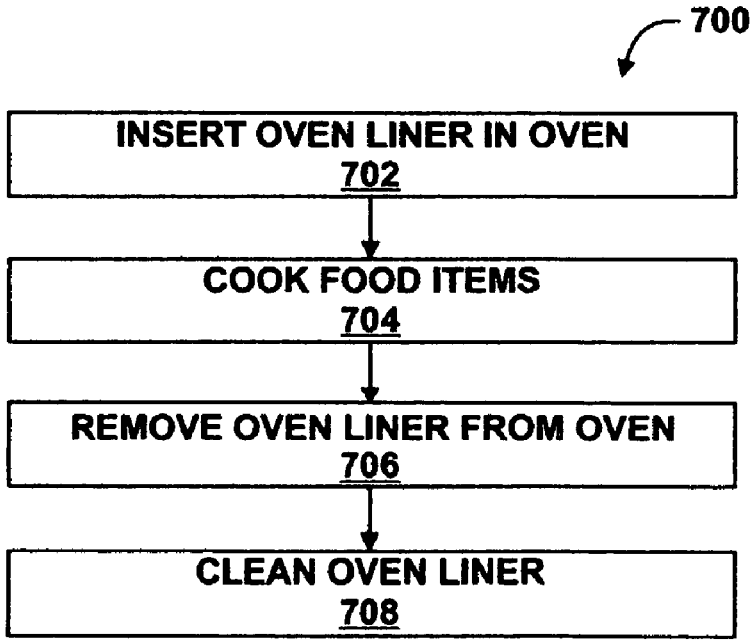
FIG. 7 includes a flow diagram illustrating an exemplary method for cleaning an oven.

FIG. 7 illustrates an exemplary method 700 for cleaning an oven. An oven liner is inserted in the oven, as shown at 702. For example, the oven liner may be placed at the bottom of a conventional oven or microwave oven, or in an oven tray of a microwave oven. The oven liner includes one side formed of high coefficient of friction material and a second side formed of low coefficient of friction material. The side formed of the high coefficient of friction material may be placed face down in the oven chamber or oven tray.

Food items may be cooked in the oven, as shown at 704. Such cooking generally results in splatter or spillage on the oven liner. To clean the oven, the oven liner is removed from the oven, as shown at 706. The oven liner may then be easily cleaned, as shown at 708. The oven liner may optionally be returned to the oven.

In one particular embodiment, the multi-layered oven liner and cleaning methods incorporating same as described above are particularly advantageous. For example, the oven liner may provide a removable liner that prevents sticking of food spills to the oven, while preventing sliding when placed on oven surfaces. In a further exemplary embodiment, the low surface energy materials are stain resistant and provide easy-to-clean non-stick surfaces. In another exemplary embodiment, the oven liner exhibits slide resistance relative to the oven surfaces or oven tray.

According to some aspects of the above embodiments, the multi-layered composite structure is less likely to slip across an oven surface or microwave oven tray than PTFE sheets. In addition, the multi-layered composite structure is easier to clean than silicone sheets.

Further details of the construction of the liner may be found in U.S. Patent Application Publication No. U.S. 2001/0034170A1 (U.S. '170), incorporated herein by reference. It is noted that the U.S. '170 is generally directed to composite structures utilized in the context of closed-loop belts, not in the context of oven liners, and methods of cleaning ovens incorporating same.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A method for cleaning an oven, the method comprising:

placing an oven liner in an oven, the oven liner having a first major surface formed of silicone elastomer and having a second major surface formed of fluorinated polymer;

cooking food items in the oven and over the oven liner; and removing the oven liner.

2. The method of claim 1, further comprising cleaning the oven liner.

3. The method of claim 2, further comprising placing the oven liner back into the oven after cleaning the oven liner.

4. The method of claim 1, wherein the oven is a microwave oven.

5. The method of claim 4, further comprising:

placing the oven liner on an oven tray within the microwave oven; and placing the oven liner such that the first major surface substantially contacts the oven tray and the second major surface is configure to receive food items for cooking.

6. The method of claim 1, wherein the oven is a conventional oven.

7. The method of claim 6, further comprising placing the oven liner such that the first major surface substantially contacts a bottom of an oven cooking chamber of the conventional oven and the second major surface is configured to receive spills from the food items.

8. The method of claim 1, wherein the oven liner is heat resistant to temperatures at least about 550 F.

9. The method of claim 1, wherein the oven liner includes fibrous reinforcement.

10. The method of claim 9, wherein the fibrous reinforcement is woven.

11. The method of claim 10, wherein the fibrous reinforcement comprises woven polyaramid or fiberglass yarns.

12. The method of claim 9, wherein the fibrous reinforcement is coated with the fluorinated polymer.

13. The method of claim 1, wherein the silicone elastomer has a higher coefficient of friction than the fluorinated polymer.

14. A merchandised article comprising:

an oven liner having a first major surface formed of silicone elastomer and having a second major surface formed of fluorinated polymer;

packaging coupled to the oven liner, the packaging providing a sales message associated with the oven liner; and printed instructions included with the packaging, the printed instructions directing a user to place the oven liner in an oven prior to cooking a food item.

15. The merchandised article of claim 14, wherein the printed instructions direct a user to place the oven liner such that the first major surface substantially contacts a lower surface of the oven.

16. The merchandised article of claim 14, wherein the printed instructions direct a user to remove the oven liner from the oven after cooking a food item.

17. The merchandised article of claim 16, wherein the printed instructions direct a user to clean the oven liner after removing the oven liner from the oven.

18. A method of cleaning an oven, the method comprising:

placing an oven liner in an oven, the oven liner having a first major surface formed of elastomeric material having a high coefficient of friction, the oven liner having a second major surface formed of a polymeric material having a low coefficient of friction;

cooking a food item in the oven; and removing the oven liner from the oven.

19. The method of claim 18, wherein the elastomeric material includes silicone rubber.

20. The method of claim 18, wherein the polymeric material includes fluorinated polymer.

* * * * *